US005199891A

United States Patent [19]

Reed

[11] Patent Number: 5,199,891

[45] Date of Patent: Apr. 6, 1993

[54] CABLE STRAIN RELIEF FOR SHIELDED ELECTRICAL CONNECTOR

[75] Inventor: Carl G. Reed, Clemmons, N.C.

[73] Assignee: AMP Incorporated, Harrisburg, Pa.

[21] Appl. No.: 882,322

[22] Filed: May 13, 1992

[51] Int. Cl.[5] ..... H01R 13/698

[52] U.S. Cl. ..... 439/98; 439/610; 439/676; 439/452

[58] Field of Search ..... 439/98, 99, 452, 456, 439/457, 610, 676

[56] References Cited

U.S. PATENT DOCUMENTS 4,477,132 10/1984 Moser et al. .
4,662,067 5/1987 Abraham ..... 439/98 X
4,781,623 11/1988 Philippson et al. ..... 439/676 X

FOREIGN PATENT DOCUMENTS 2741791 7/1978 Fed. Rep. of Germany ..... 439/98

*Primary Examiner*—Eugene F. Desmond
*Attorney, Agent, or Firm*—Bruce J. Wolstoncroft

[57] ABSTRACT

An electrical connector (4) terminated to signal wires (SW) of a shielded electrical cable (C) having a drain wire (DW), has an insulating housing (8) containing electrical terminals having contacts (40) electrically connected to the signal wires of the shielded electrical cable (C). A metal shield (14) covering the lower part of the housing (8) has a grounding clip (48) connected to the rear wall (28) of the shield (14) by means of a strap (62). The grounding clip receives an end portion of the cable (C) from which the signal wires (SW) extend to the contacts (40) of the connector (4). The drain wire (DW) is wound in a circuitous path about tabs (58) of the grounding clip (48). The grounding clip can be bent about the strap (62) to line in a channel (36) between two rows of the contacts (40) of the connector (4), after the grounding clip has been wound about with insulative tape (T). The drain wire (DW) accordingly provides strain relief, if the cable (C) is inadvertently pulled, for the electrical connections between the contacts (40) and the signal wires (SW).

17 Claims, 7 Drawing Sheets

CABLE STRAIN RELIEF FOR SHIELDED ELECTRICAL CONNECTOR

BACKGROUND OF THE INVENTION

This invention relates to the provision of cable strain relief in a shielded electrical connector for terminating electrical cables having drain wires; to a metal shield adapted to provide for cable strain relief and to an electrical connector provided with such a shield. Where signal wires of a shielded electrical cable have been terminated to electrical terminals of an electrical connector, it is desirable that the electrical connections between the signal wires and the terminal should be protected against accidental tensioning of the cable.

U.S. Pat. No. 4,477,132 discloses an electrical connector comprising a metal sleeve having a locking cap rotatably mounted on the sleeve to extend from a mating end of the connector. An insulating terminal locating block is received as a close fit within the sleeve to locate terminals projecting from the mating end, a retention bush being provided to retain the terminal locating block in the sleeve. The terminal locating block comprises two parts, and is formed with a terminal receiving recess at the mating end, communicating with a cable receiving recess at a rear end. There extends across the cable receiving recess, a cable clamping rib, a drain wire receiving passageway extending radially through the block. Such clamping means for providing cable strain relief are relatively expensive to provide and the drain wire receiving in the passageway does not contribute to the relief of the strain on the cable.

SUMMARY OF THE INVENTION

The present invention is intended to provide, in an electrical connector, strain relief for the signal wires of a shielded electrical cable which has been terminated to the connector, by cooperation between a drain wire of the cable and metal shielding of the connector.

According to the present invention, in an electrical connector terminating signal wires of a shielded electrical cable having a drain wire, the connector comprising an insulating housing containing electrical terminals having contacts electrically connected to signal wires of the electrical cable and metal shielding covering at least a part of the insulating housing; a grounding clip connected to the metal shielding receives an end part of the cable from which the signal wires extend to contacts of the connector, the drain wire of the cable being wound in a circuitous part about the grounding clip thereby to provide strain relief for the electrical connections between the contacts of the terminals and the signal wires of the cable.

Most economically, the metal shield for the housing may be stamped and formed from a single piece of sheet metal stock so as to include the grounding clip. In order to provide strain relief for the shielded cable, all that is necessary to do, is to wind the drain wire about the grounding clip. Preferably, the grounding clip is provided with a plurality of pairs of opposed notches, for receiving the drain wire and thereby ensuring that it cannot slip from the grounding clip. Additionally, a length of insulative tape may be would about the grounding clip. The whole of the drain wire projecting from the cable end portion should be wound about the grounding clip, preferably so as to assume a figure of eight configuration. In order to enable this, the notches are preferably formed in opposite edges of tabs projecting from cable embracing arms of the grounding clip, beyond the cable end portion when it is received in the grounding clip.

The grounding clip may be provided on a strap upstanding from a wall of the metal shield, the insulating housing of the connector defining a channel extending between rows of the contacts for connection to the signal wires, the strap being flexible so that the grounding clip can be located in the channel, after the cable end portion has been received in the grounding clip, the drain wire has been wound thereabout and the insulative tape has been wound about the grounding clip and the drain wire. The insulative tape prevents accidental short circuiting between the contacts of the connector and the grounding clip for the drain wire.

DETAILED DESCRIPTION OF THE PREFERRED EMBODIMENT OF THE INVENTION

Figure 1:
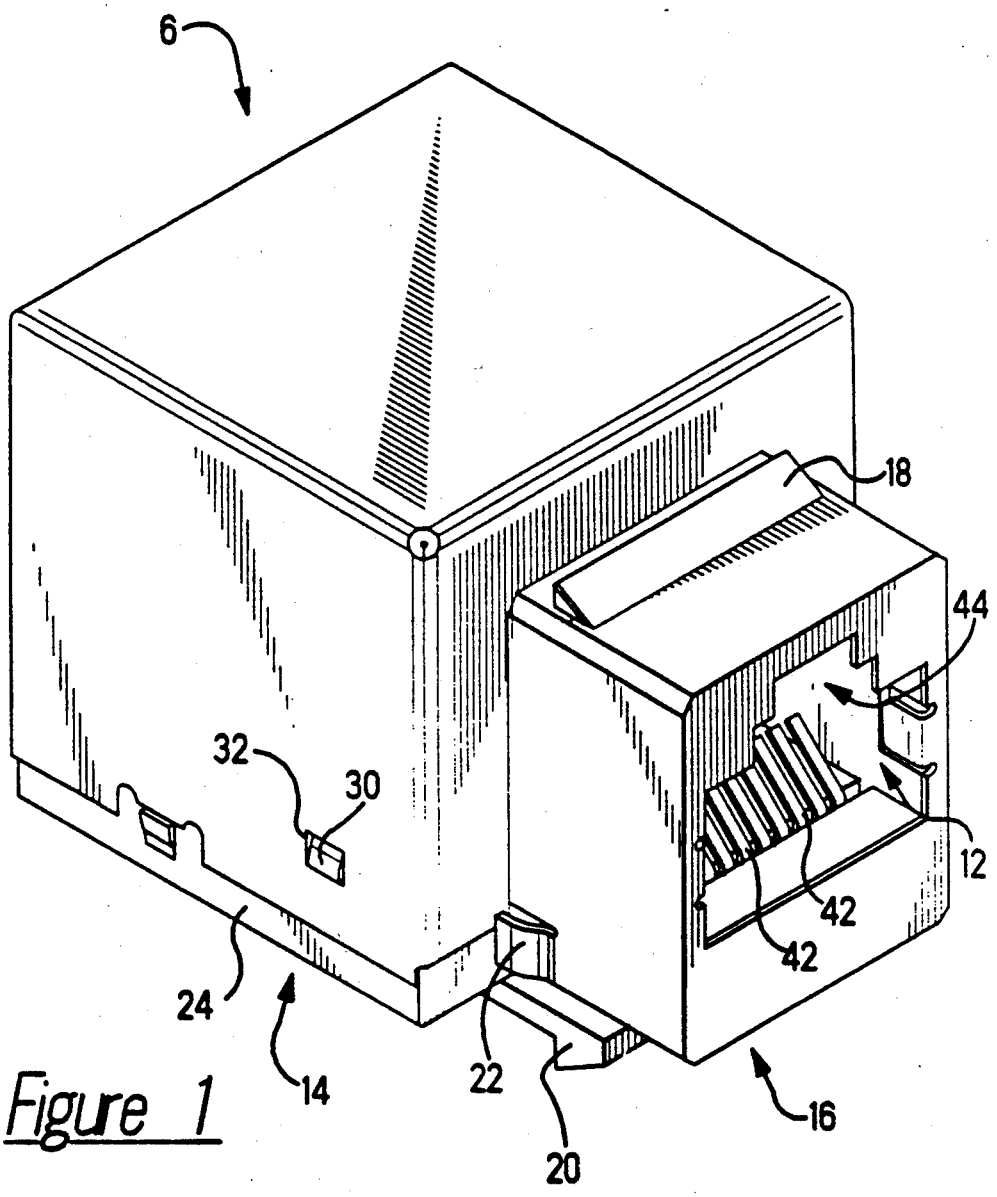
FIG. 1 is an enlarged isometric front view of a shielded, panel mount electrical jack, comprising a jack connector and a main shield.
Figure 2:
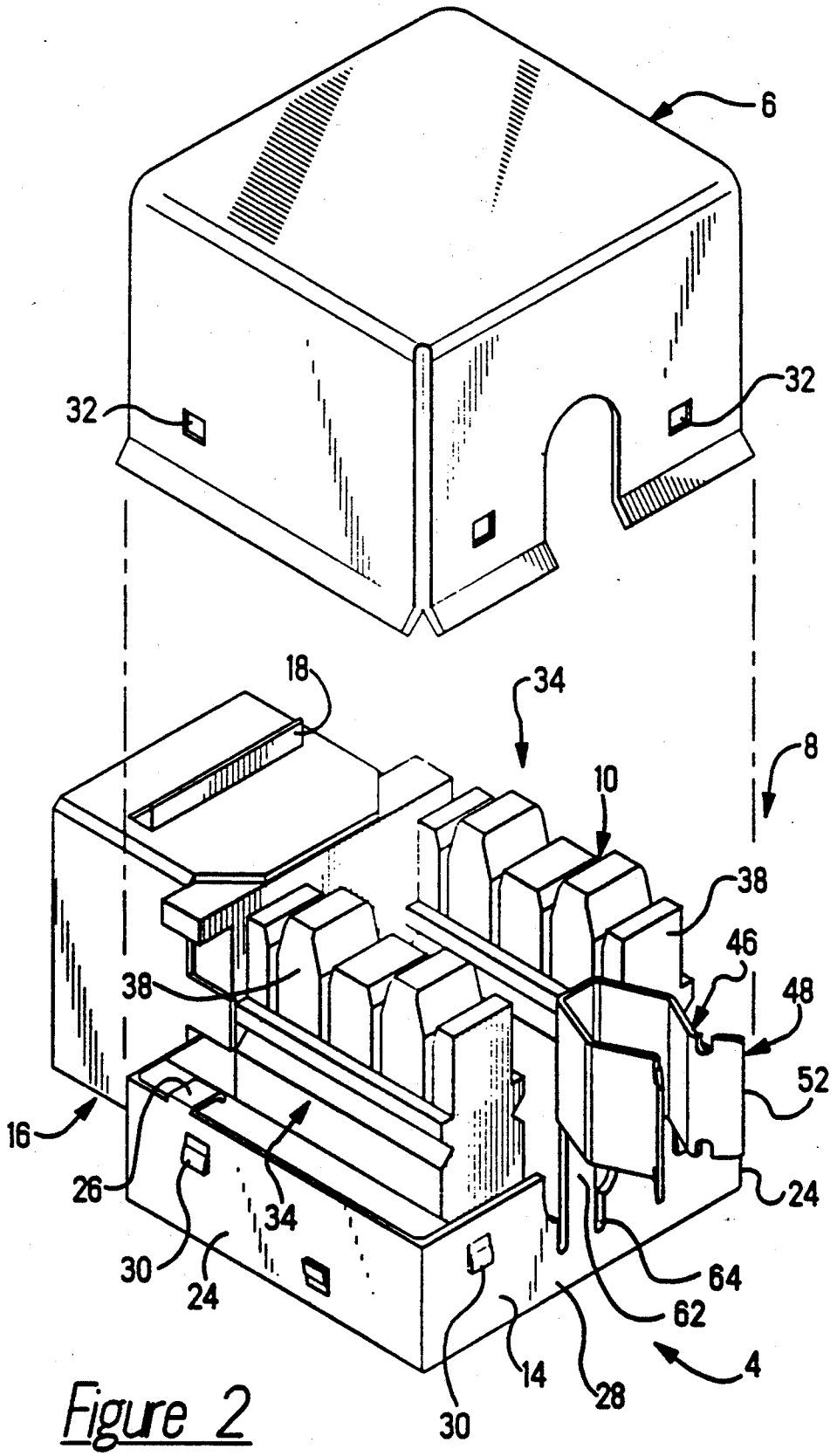
FIG. 2 is an exploded isometric view of the panel mount jack.

As shown in FIGS. 1 and 2, a shielded, panel mount electrical jack comprises a partially shielded jack connector 4 and a main metal shield 6.

The connector 4 comprises a one piece insulating housing 8 having a wire connecting rear part 10 and a mating, forward jack part 12. The lower part and the base of the wire connecting part 10 are surrounded by a one piece metal shield 14, the jack part 12 being surrounded by a one piece metal shield 16 which is open forwardly. A panel engaging member 18 of the jack part 12 projects through the upper wall of the shield 16, and panel engaging latch arms 20, only one of which is shown, project forwardly from the wire connecting part 10 beneath the jack part 12, the shield 16 having rearwardly projecting panel engaging tabs 22, only one of which is shown. The shield 14 which is in the form of a tray, has side walls 24 with peened over tabs 26, only one of which is shown, securing the shield 14 to the housing 8. The side walls 24 are spanned by a rear wall 28 of the shield 14. Latching tabs 30 are provided on the walls 24 and 28 for co-operation with latching openings 32 in the main shield 6 for securing it to the connector 4.

The wire connecting part 10 of the housing 8 comprises pair of opposed, parallel wire combs 34 upstanding from the base of the housing part 10 and defining between them a channel 36. Each comb 34 has five teeth 38 and between the teeth 38 of each adjacent pair of teeth, an insulation displacement, slotted plate contact 40 (FIG. 13) of an electrical terminal having a mating contact spring 42 (FIG. 1) projecting obliquely upwardly into a forward opening 44 of the housing part 12, for receiving a mating, shielded electrical plug (not shown) having contacts for engaging the respective contact springs 42. Below each wire comb 34 the housing 8 has an outer wire supporting ledge 43 extending longitudinally of the comb 34.

Figure 9:
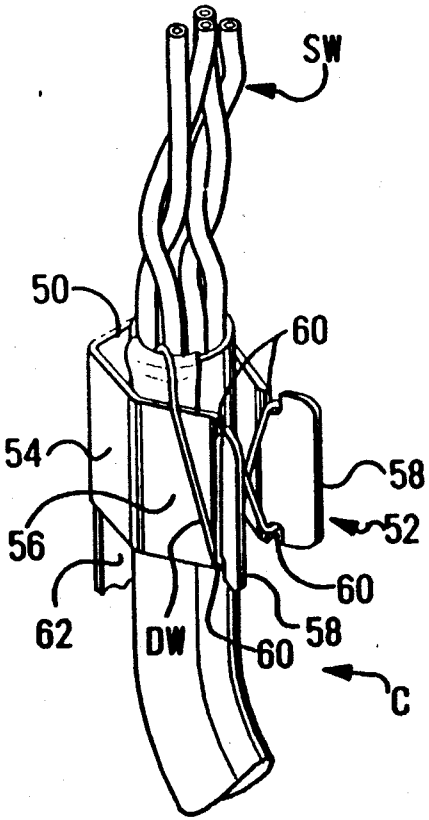
FIGS. 8 and 9 are fragmentary isometric views illustrating respective successive steps in winding a drain wire of the cable about the grounding clip.
Figure 8:
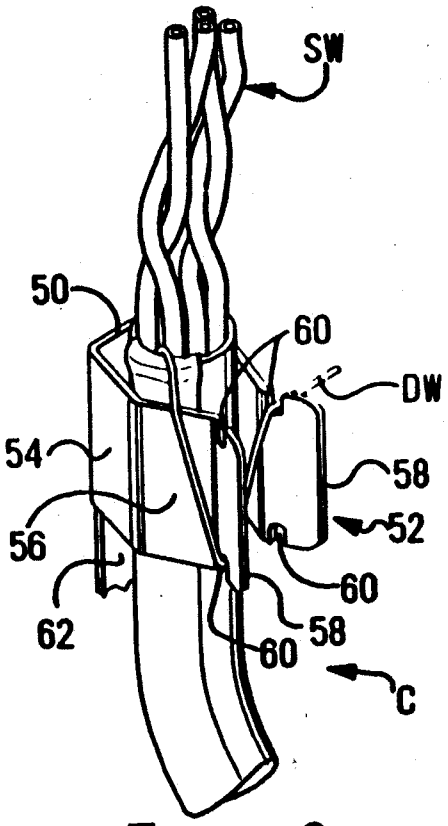

A grounding clip, generally referenced 46, formed integrally with the rear wall 28 of the shield 14 of the housing part 10, comprises a substantially U-shaped clip portion 48 having a base 50 from opposite edges of which project rearwardly, opposed clip arms 52. Each arm 52 has a forward planar part 54 connected to the base 50, an intermediate planar part 56 connected to the part 54 and being angled slightly inwardly with respect thereto and a rearward tab 58 connected to the part 56 and being angled slightly outwardly with respect thereto, so that the tabs 58 co-operate to define a rearwardly flared, cable guiding mouth. Each tab 58 has formed in its upper and lower edges, respectively, upper and lower, opposed, drain wiring receiving notches 60, as best seen in FIGS. 8 and 9. Each notch 60 is disposed proximate to the free end of the respective arm 52. The base 50 of each clip portion 48 is connected to the wall of the shield 14, by means of a flexible, rectilinear strap 62 coplanar with the wall 28 and upstanding from the bottom of a notch 64 in the wall 28.

Figure 3:
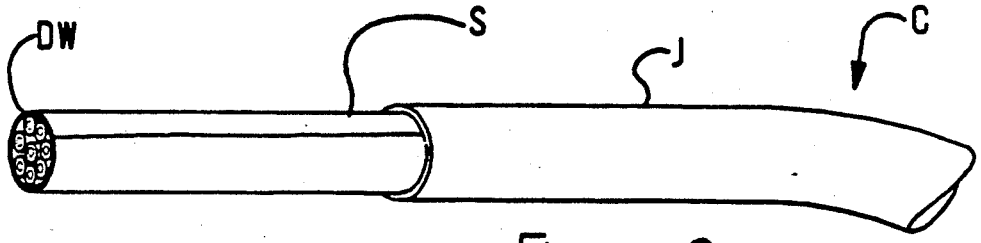
FIGS. 3 to 5 are isometric views illustrating respective consecutive steps in preparing an end portion of a shielded electrical cable for termination to the jack connector.
Figure 4:
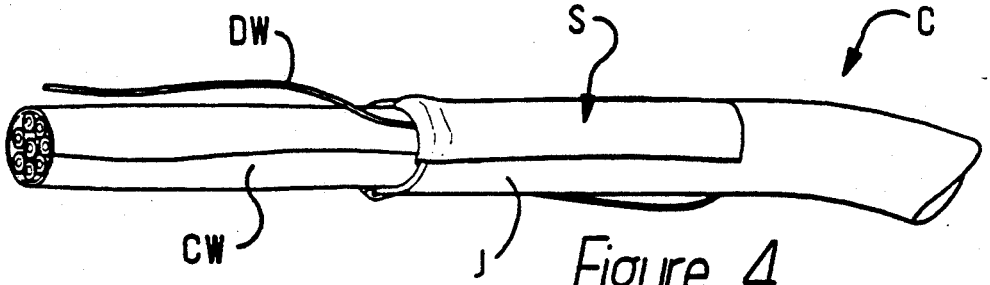
Figure 5:
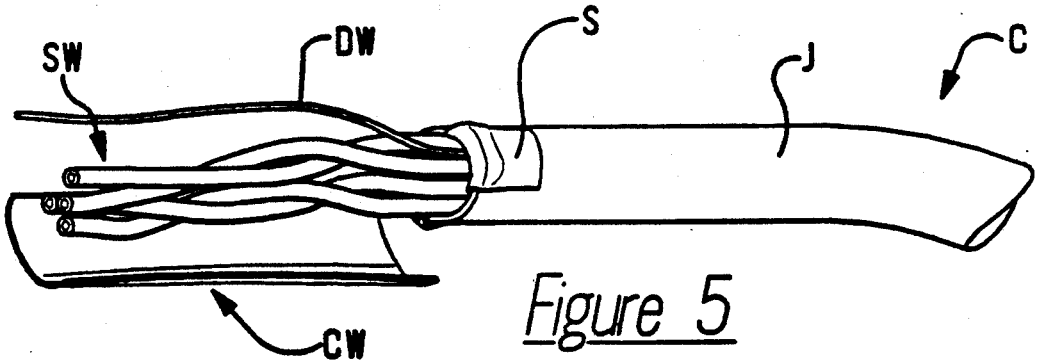

The manner in which an end portion of a shielded electrical cable C is prepared for termination to the connector 4, will now be described with reference to FIGS. 3 to 5. The cable C comprises an outer insulating jacket J, a metal foil shield S beneath the jacket J, a drain wire DW extending along the cable C between the jacket J and the foil shield S, and beneath the shield S, clear wrapping CW enclosing four twisted pairs of insulated signal wires generally referenced SW. In order to prepare the cable end portion for termination of the wires SW to the contacts 40 of the connector 4, the jacket J is stripped back as shown in FIG. 3, exposing the shield S and the drain wire DW, the metal foil of the shield S is folded back over the jacket J as shown in FIG. 4, and the clear wrapping CW is removed from the wires SW as shown in FIG. 5, care being taken to avoid severing the drain wire DW.

Figure 6:
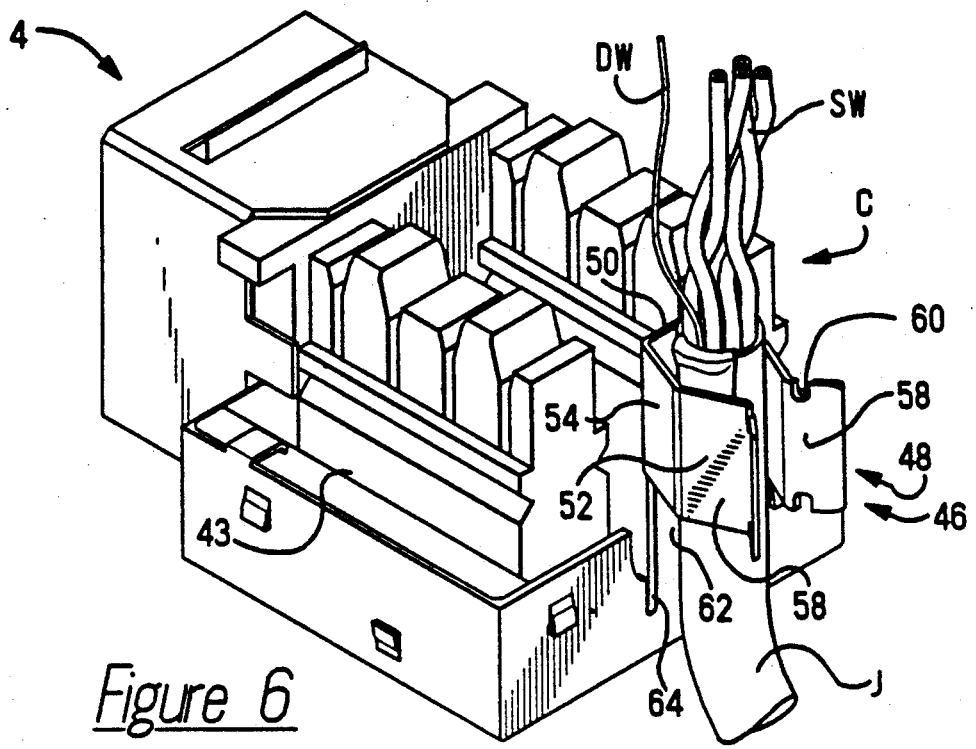
FIGS. 6 and 7 are isometric views illustrating respective consecutive steps in locating the cable end portion in a grounding clip of the jack connector.
Figure 7:
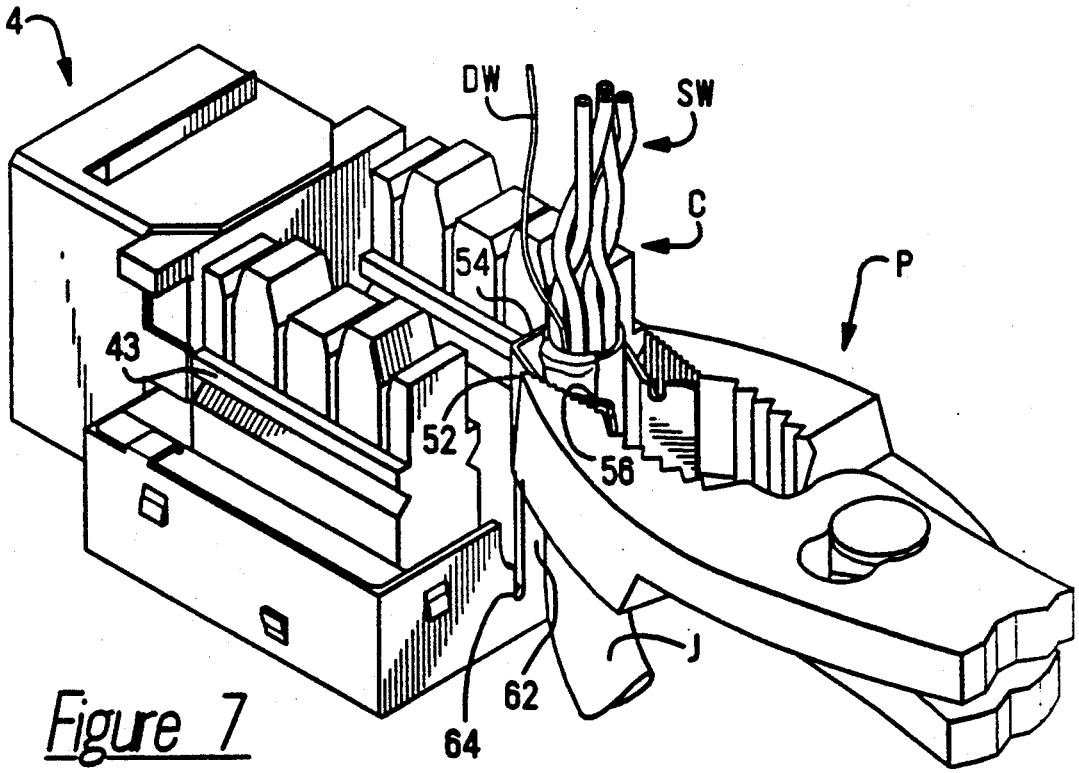

The part of the cable C proximate to the exposed signal wires SW is inserted between the arms 52 of the clip portion 48 of the cable clip 46, guided by the mouth provided by the tabs 58. As shown in FIG. 6, the jacket J is gripped between the clip arms 52, the drain wire DW being nearest to the base 50 of the clip portion 48. The clip portion 48 is then closed by grasping the tabs 58 between the jaws of a pair of needle point pliers P as shown in FIG. 7. The tabs 58 may, however, be gripped between the fingers for the purpose of closing the clip portion 48. The closing of the clip portion 48 is facilitated, because the parts 56 of the arms 52 are easily bent inwards about their junctions with the parts 54 as will be apparent from FIGS. 8 and 9, the tabs 58 being easily bent inwards about their junctions with the parts 56 of the arms 52. By the use of the pliers P or the finger, the drain wire DW is laced through the lower notch 60 of one of the tabs 58 and the upper notch 60 of the other tab 58 as shown in FIG. 8, and the drain wire, which is, of course, stiffly flexible, is wound about the tabs 58 as shown in FIG. 9, to follow a circuitous path. Preferably, the drain wire DW is led down externally of the other tab 58, is passed through a lower notch 60 thereof, and up between the tabs 58 through the upper notch 60 of the one tab 58 and is led down externally of that tab and through the lower notch 60 thereof, as shown in FIG. 9, the free end of the drain wire DW being left between the tabs 58, whereby the drain wire DW has a figure of eight configuration. In any event, the whole of the drain wire DW should be wrapped about the tabs 58, the free end of the wire DW being finally disposed therebetween.

Figure 10:
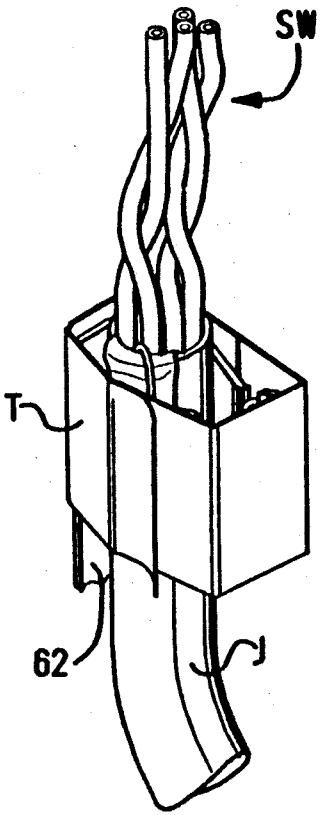
FIG. 10 is a fragmentary isometric view showing an insulative tape wrapped about the ground clip.
Figure 11:
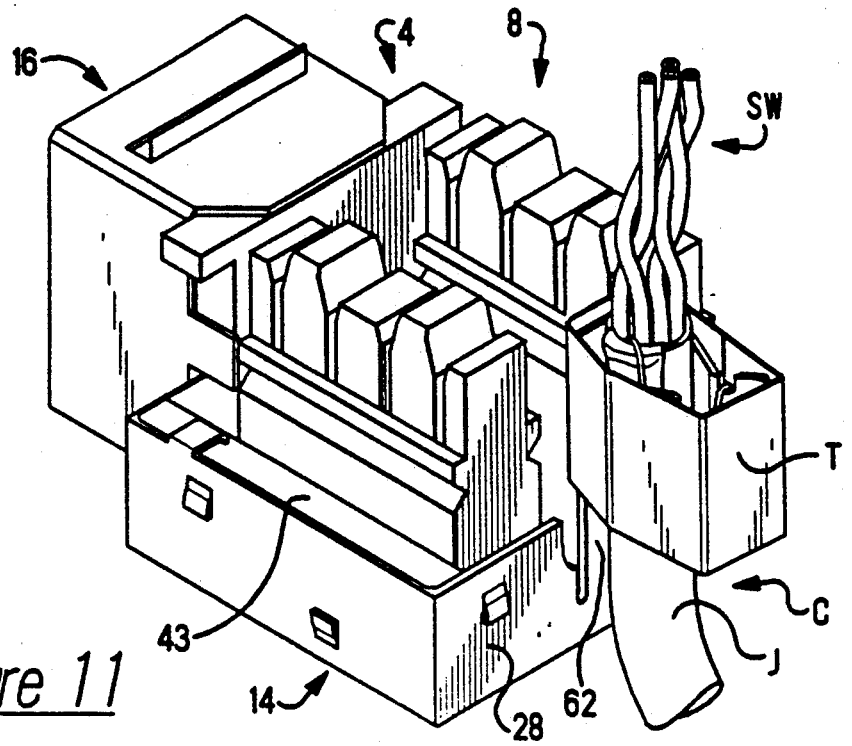
FIG. 11 is an isometric view of the jack connector showing the insulative tape wrapped about the grounding clip.
Figure 12:
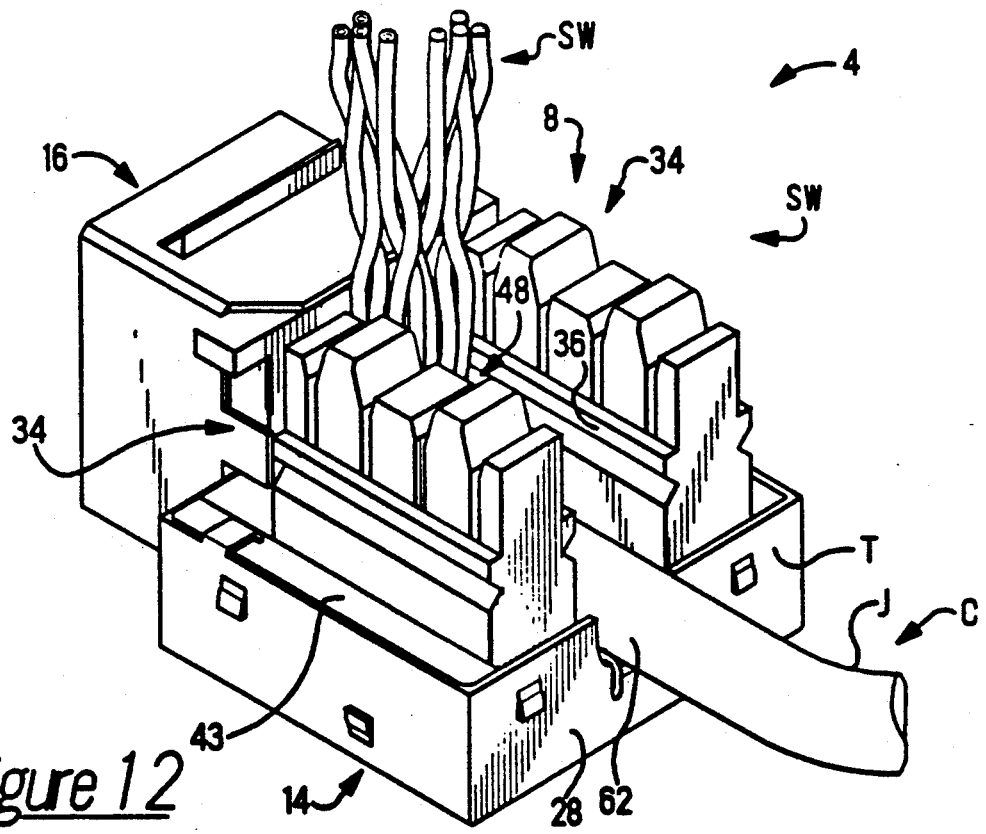
FIG. 12 is an isometric view illustrating a first step in terminating twisted pairs of insulated wires of the cable to contacts of the jack connector.
Figure 13:
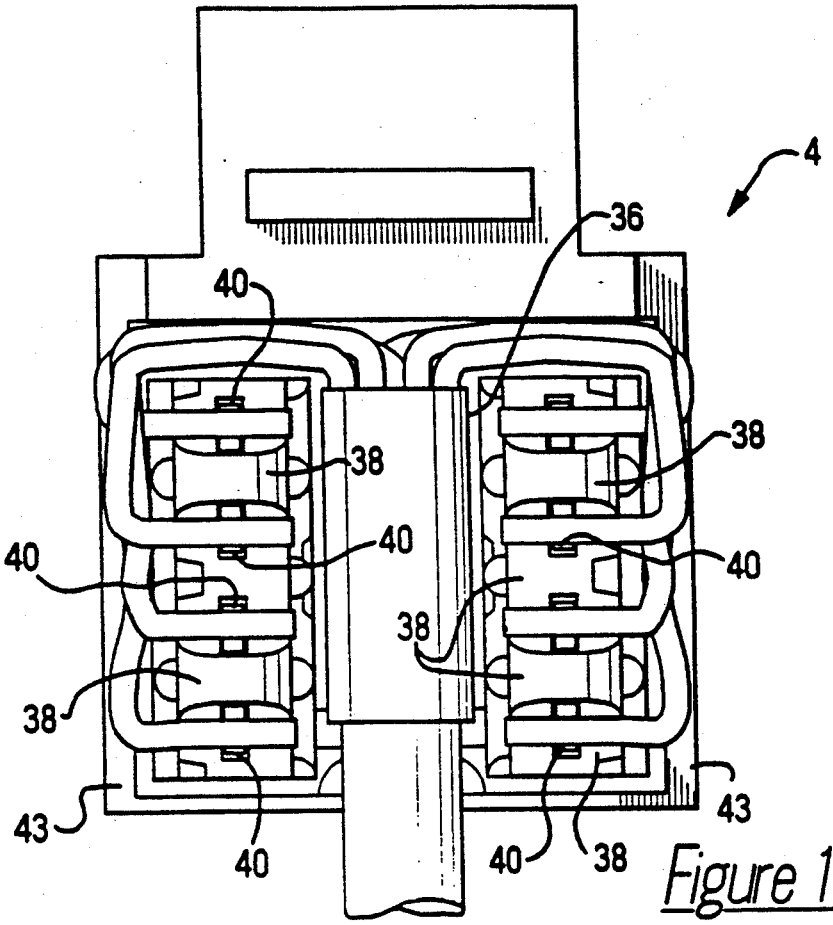
FIG. 13 is a top plan view of the jack connector showing the insulated wires terminated to the contacts of the jack connector.

The drain wire having been wrapped about the tabs 58, a length of wide, vinyl insulative tape T is wound about the clip portion 48, preferably by one and a half turns, as shown in FIGS. 10 and 11. The signal wires SW are then bent back at right angles to the cable C, without untwisting them and the clip portion 48 is bent down into the channel 36 between the combs 34, about the strap 62 so that the signal wires SW project upwardly from the connector 4, between the combs 34, as shown in FIG. 12. As shown in FIG. 13, two of the twisted pairs of wires SW are laid across the forward end of one comb 34, the remaining two twisted pairs being laid across the forward end of the other comb 34 in the opposite direction to the first two twisted pairs and the end portions of the wires SW are inserted sequentially between respective pairs of adjacent teeth 38 of the combs 34, in accordance with a predetermined color code and the free end portion of each wire SW is driven into the respective insulation displacement contact 40 by means of a suitable tool (not shown) whereby the metal core of each wire SW is electrically connected to a respective contact 40 and thus to a respective contact spring 42. During each insertion operation, the tool trims the end of the respective wire SW proximate to the channel 36. The portions of the wires SW on the outside of each comb 34 are pressed down against the adjacent edge 43.

Figure 14:
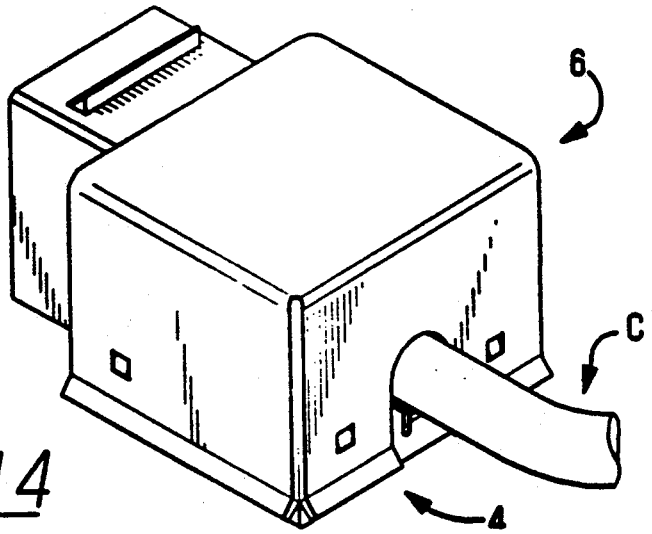
FIG. 14 is an isometric view taken from the rear showing the main shield as secured to the jack connector after the cable has been terminated thereto.

The connector 4, when so wired, may be used simple as a grounded connector, or the main shield 6 may be secured thereto as shown in FIG. 14 for the connector 4 to be used as a fully shielded connector.

Since the drain wire is tightly secured to the tabs 58 of the grounding clip 46, the drain wire DW affords strain relief for the electrical connections between the wires SW and the contacts 40, should the cable C be inadvertently tensioned, no other strain relief means being required. The shield 14 can readily be stamped and formed from a single piece of sheet metal so as to include the grounding clip 46.

I claim:

1. In an electrical connector terminating signal wires of a shielded electrical cable having a drain wire, the connector comprising an insulating housing containing electrical terminals having contacts electrically connected to the signal wires of the shielded electrical cable and metal shielding covering at least part of the insulating housing; a grounding clip connected to the metal shielding and receiving an end portion of the shielded electrical cable from which portion the signal wires extend to the said contacts of the connector, the drain wire of said cable being wound in a circuitous path about the grounding clip thereby providing strain relief for the electrical connections between said contacts and the signal wires of the shielded electrical cable.

2. The invention recited in claim 1, wherein the end portion of the shielded electrical cable is received between opposed clip arms of the grounding clip, each clip arm being formed with a plurality of notches through which the drain wire extends.

3. The invention as recited in claim 1, wherein said circuitous path is of substantially figure of 8 configuration.

4. The invention recited in claim 1, wherein the grounding clip comprises a clip portion having a pair of opposed clip arms embracing said end portion of the cable, each clip arm terminating in a tab having a free end, each tab being formed with a pair of opposed notches proximate to its free end, and the drain wire extending through the notches, the drain wire having a free end disposed between the tabs.

5. The invention recited in claim 4, wherein at least one turn of the drain wire extends about each one of the tabs.

6. The invention as recited in claim 4, wherein each tab has an upper notch and a lower notch, the drain wire extending from said end portion of the cable externally of the one tab, through the lower notch of the one tab, between the tabs, through the upper notch of the other tab, externally of the other tab, through the lower notch of that tab, between the tabs, through the upper notch of the one tab, externally of that tab, and through the lower notch of that tab, whereby the drain wire follows a substantially figure of eight configuration path.

7. The invention as recited in claim 1, wherein the contacts of the terminals of the electrical connector are arranged in two spaced, parallel rows, the grounding clip being disposed between said rows of contacts and comprising a strap connected to the metal shielding at one end of said rows of contacts, an insulative tape being wound by at least one turn about the grounding clip.

8. A one piece metal shield for an electrical connector for terminating a shielded electrical cable having a drain wire, the shield comprising walls for receiving between them an insulating housing of the connector, a strap upstanding from one of said walls, and a substantially U-shaped clip surmounting strap, the grounding clip comprising a base from which project a pair of clip arms, each having a cable embracing portion extending from the base of the grounding clip, for receiving between them an end portion of the cable, each clip arm terminating at its end remote from the base in a tab having a free end, the tabs diverging from each other in a direction away from base, each tab having formed in each of two opposite edges thereof, a notch for receiving the drain wire when wound in a circuitous path about the tabs.

9. A shield as recited in claim 8, wherein the strap extends vertically from said one wall and is connected to the base in coplanar relationship therewith, the clip arms extending in vertical planes and the notches being formed in upper and lower edges of the tabs.

10. A shield as recited in claim 8, wherein said one wall has a notch formed therein, the notch having a base, the strap being vertically elongate and extending from the base of the notch.

11. A shield as recited in claim 8, wherein each cable embracing portion of each clip arm comprises a first part connected to the base of the grounding clip and a second part connected to the first part and being angled inwardly of the grounding clip with respect to said first part, about the junction between said first and second parts.

12. A shield as recited in claim 8, wherein said walls comprise a pair of opposite side walls and a rear wall spanning the side walls, the strap upstanding from said rear wall and the clip arms projecting rearwardly of the rear wall.

13. An electrical connector for terminating signal wires of a shielded electrical cable having a drain wire, the connector comprising;

insulating housing having a wire connecting rear part and a mating forward part;

a plurality of electrical terminals, contained in the insulating housing and each having a mating portion exposed in a mating part of the housing, for mating engagement with the complimentary electrical mating member, and a wire connecting portion in the wire connecting part of the housing; and a metal shield extending about at least the wire connecting part of the housing and having a rear wall, the grounding clip comprising a strap upstanding from said rear wall and a grounding clip portion surmounting the strap, the grounding clip having a pair of cable embracing clip arms projecting rearwardly of the rear wall and each having a free end, each clip arm having formed therein a pair of opposed notches for receiving the drain wire when wound about said clip arms so as to follow a circuitous path.

14. A connector as recited in claim 13, wherein the wire connecting part of the insulating housing defines an upwardly open channel opening rearwardly of said wire connecting part, said strap being deformable to locate said grounding clip portion in said channel.

15. A connector as recited in claim 14, wherein said wire connection portions of said terminals are arranged in two rows, one on each side of said channel, a pair of wire combs providing side walls of said channel having upwardly projecting teeth, said wire connecting portions being located between an adjacent pair of said teeth.

16. A connector as recited in claim 14, wherein said strap is coplanar with said rear wall of the metal shield, said rear wall being formed with an upwardly open notch having a base, said strap upstanding from said base of said notch.

17. A connector as recited in claim 13, wherein said grounding clip portion has a base which is coplanar with said strap, said clip arms projecting from opposite edges of said base and each having cable embracing portion and terminating at its end remote from the base in a tab having a free end, the tabs diverging in a direction away from the base, said notches being formed in upper and lower edges of said tabs.

* * * * *